US007102575B2

(12) United States Patent
Pan

(10) Patent No.: US 7,102,575 B2
(45) Date of Patent: Sep. 5, 2006

(54) PIFA ANTENNA APPARATUS FOR MOBILE COMMUNICATIONS TERMINALS

(75) Inventor: Sheng-Gen Pan, Kamp-Lintfort (DE)

(73) Assignee: Siemens Aktiengesellschaft, Munich (DE)

( * ) Notice: Subject to any disclaimer, the term of this patent is extended or adjusted under 35 U.S.C. 154(b) by 0 days.

(21) Appl. No.: 10/432,789

(22) PCT Filed: Nov. 5, 2001

(86) PCT No.: PCT/DE01/04148

§ 371 (c)(1),
(2), (4) Date: Nov. 24, 2003

(87) PCT Pub. No.: WO02/43182

PCT Pub. Date: May 30, 2002

(65) Prior Publication Data

US 2004/0075610 A1 Apr. 22, 2004

(30) Foreign Application Priority Data

Nov. 24, 2000 (DE) ..... 100 58 387

(51) Int. Cl.
*H01Q 1/24* (2006.01)

(52) U.S. Cl. ..... 343/702; 343/700 MS; 343/767

(58) Field of Classification Search ..... 343/700 MS, 343/702, 767, 770, 846
See application file for complete search history.

(56) References Cited

U.S. PATENT DOCUMENTS

| | | | | |
|---|---|---|---|---|
| 5,319,378 A | 6/1994 | Nalbandian et al. | . | 343/700 MS |
| 6,114,996 A | 9/2000 | Nghiem | ..... | 343/700 MS |
| 6,195,048 B1 * | 2/2001 | Chiba et al. | ..... | 343/700 MS |
| 6,326,921 B1 * | 12/2001 | Egorov et al. | ..... | 343/700 MS |
| 2001/0050643 A1 * | 12/2001 | Egorov et al. | ..... | 343/702 |

FOREIGN PATENT DOCUMENTS

| | | |
|---|---|---|
| EP | 07 77 295 | 6/1997 |
| EP | 08 71 238 | 10/1998 |
| EP | 09 42 488 | 9/1999 |
| EP | 0 997 974 | 5/2000 |
| EP | 1 003 240 | 5/2000 |
| EP | 1 024 552 | 8/2000 |
| JP | 11-150415 | 6/1999 |
| JP | 2000-68736 | 3/2000 |
| WO | WO 98/44588 | 10/1998 |
| WO | WO 99/28990 | 6/1999 |

* cited by examiner

*Primary Examiner*—Hoang V. Nguyen
(74) *Attorney, Agent, or Firm*—Bell, Boyd & Lloyd LLC

(57) ABSTRACT

A PIFA antenna device is provided which includes an HF input/output and two antenna surfaces respectively having a contact with the ground of a mobile communication terminal. The first antenna surface is configured for two independent frequencies and the second antenna surface is configured for a third independent frequency. Only the first antenna surface is connected to the HF input/output and the second antenna surface is arranged in a contactless manner with respect to the first antenna surface, whereby an electromagnetic coupling occurs between both antenna surfaces.

6 Claims, 1 Drawing Sheet

PIFA ANTENNA APPARATUS FOR MOBILE COMMUNICATIONS TERMINALS

BACKGROUND OF THE INVENTION

A PIFA antenna apparatus (Planar Inverted F-Antenna) is known from JP 11-150415. The antenna apparatus described there having an inner antenna surface, which is in the form of a passive element, and an outer antenna element, which is approximately annular, has the disadvantage that it can be operated at only two different resonant frequencies.

Furthermore, an antenna apparatus is known from JP 2000-68736 which, on the basis of a ground surface, has two or more antenna surface branches, which each operate at individual resonant frequencies. The branching antenna surface is equipped with a single radio-frequency connection.

A PIFA antenna apparatus in the form of a so-called stacked PIFA antenna, is likewise known from the prior art, namely from EP 0 871 238 A2, but this requires a considerable volume, which is disadvantageous for use in the mobile radio field, particularly for installation in a cellular telephone.

In order to reduce the volume of a PIFA antenna, U.S. Pat. No. 6,195,048 B1 proposes the provision of both an inner antenna surface and an outer antenna surface surrounding the inner antenna surface, both of which are connected to a radio-frequency connection and have a common groundpoint. An antenna such as this cannot be operated as a tri-band antenna since the two antenna surfaces that are provided can be operated, respectively in only a single resonant band.

An antenna for mobile communications terminals should comply with both technical and visual requirements. Firstly, it should operate for more than one frequency while, secondly, it should be as small as possible in order, for example, to allow it to be integrated in a mobile radio in such a way that it cannot be seen from the outside. By way of example, a PIFA antenna, which has an extremely compact form, may be used for this purpose.

These PIFA antennas generally operate in two independent frequency bands; for example, in the 900 MHz frequency band for GSM operation (GSM=Global System for Mobile Communication) and in the 1800 MHz frequency band for PCN operation (PCN=Personal Communications Network). The introduction of a further, third frequency, such as in the frequency band for PCS operation (PCS=Personal Communications Services) of 1900 MHz, has until now been implemented mainly with the aid of the refinements described in the following text.

One known refinement for introducing a third frequency provides for the bandwidth of the PCN frequency band of a dual-band antenna to be widened by increasing the distance between the antenna and the printed circuit board (PCB) of the mobile radio. This allows the GSM/PCN dual-band antenna to be used for the PCS frequency band as well.

However, in this refinement, in order to operate in three frequency bands, the PIFA antenna requires approximately 50% more volume than a PIFA antenna which operates in only two frequency bands.

Another refinement for designing a PIFA antenna which operates in three frequency bands provides for a dual-band PIFA antenna to be combined with an additional antenna. This additional antenna provides the third resonant frequency, and the entire PIFA antenna apparatus now has three frequencies. In this case, both the dual-band PIFA antenna and the additional antenna are connected to an RF input/output of the mobile radio, with the two antennas being driven separately. This refinement once again leads to the PIFA antenna apparatus being relatively voluminous.

Since present-day mobile radios are becoming ever smaller, these PIFA antenna apparatuses which have been described so far, and which are designed for three frequency bands, are not suitable for installation in mobile radios such as these.

An object of the present invention is, thus, to develop a PIFA antenna apparatus for three frequency bands, whose volume is not significantly greater than existing dual-band PIFA antennas, thus allowing it to be installed in existing mobile radios.

SUMMARY OF THE INVENTION

Accordingly, the inventor proposes that a PIFA antenna apparatus having an RF input/output and two antenna surfaces, which have a respective contact to a ground for a mobile communications terminal, with the first antenna surface being designed for two independent frequencies and the second antenna surface being designed for a third independent frequency, be developed further such that only the first antenna surface is connected to the RF input/output, and the second antenna surface is arranged such that it does not touch the first antenna surface, in such a way that the two antenna surfaces are electromagnetically coupled. This electromagnetic coupling results in there being no need to drive the second antenna surface separately. By way of example, the first antenna surface may operate as a dual-band antenna in the frequency bands for GSM and PCN operation, while the second antenna surface provides the frequency for PCS operation.

In one embodiment of the PIFA antenna apparatus according to the present invention, the second antenna surface is designed such that it forms a $\lambda/4$ resonator when it is connected to ground. The $\lambda/4$ resonator is excited by electromagnetic coupling between the two antenna surfaces.

The length and the width of the second antenna surface can be matched to the desired third frequency. A nominal value of, for example, 50 ohms for the input impedance of the antenna apparatus at the third frequency can be provided by choice of the size of the free surface area and/or of the nonconductive medium between the two antenna surfaces. This allows the antenna to be operated without a matching network, or with a small number of matching elements, thus making it possible to avoid the losses which occur in matching circuits.

In another embodiment of the PIFA antenna apparatus according to the present invention, the antenna surfaces have kinks and bends. This allows small physical structures to be produced which are suitable for use for either two or three frequencies and which can be matched to a housing of an existing mobile radio.

In yet another embodiment of the present invention a first surface is provided, which is largely surrounded by the first antenna surface and the second antenna surface is arranged within this surface. As such, the second antenna surface can be accommodated in a cutout in the internal area of the first antenna surface without requiring any additional space. The two antenna surfaces may, in this case, be arranged in one plane (coplanar).

Furthermore, the surface which is surrounded by the first antenna surface may be rectangular. This surface is preferably matched to the length and width of the second antenna surface in such a way as to allow this second antenna surface to be arranged without touching it, and to allow electromagnetic coupling between the two antenna surfaces. The medium between the two antenna surfaces which are arranged such that they do not touch is preferably air or some other nonconductive medium.

In a further embodiment of the PIFA antenna apparatus according to the present invention, at least one second surface or cutout is provided which is bounded by the antenna surface. This allows the third frequency of the PIFA antenna apparatus according to the present invention to be tuned independently.

Additional features and advantages of the present invention are described in, and will be apparent from, the following Detailed Description of the Invention and the Figures.

DETAILED DESCRIPTION OF THE INVENTION

Figure 1:
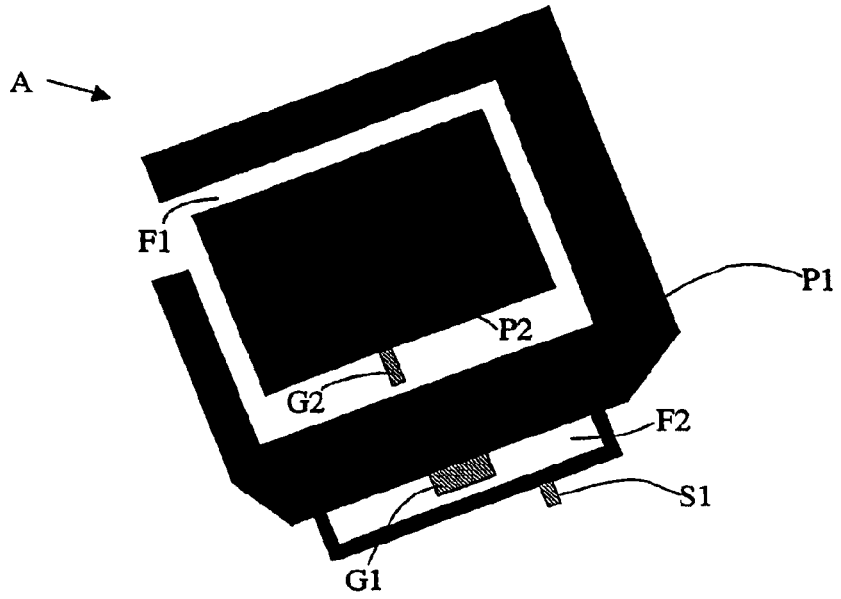
FIG. 1 shows a PIFA antenna apparatus according to the present invention

FIG. 1 shows a preferred exemplary embodiment of the PIFA antenna apparatus A according to the present invention. The PIFA antenna apparatus A has two antenna surfaces P1 and P2, with the antenna surface P1 largely bounding or surrounding a rectangular surface F1. The antenna surface P1 is open on one side. The surface F1 also may be regarded as a cutout in the antenna surface P1, or else may have a different shape. In addition, the antenna surface P1 has a contact G1 which makes contact with a ground for the mobile radio, an RF input/output S1 which connects the antenna surface P1 to an RF input/output of the mobile radio, and a further surface or cutout F2.

The antenna surface P1 represents a dual-band antenna; for example, for the 900 MHz and 1800 MHz frequency bands.

A further antenna surface P2 is arranged in the cutout F1, without any additional space being required. In this case, care must be taken to ensure that the antenna surfaces P1 and P2 do not touch one another. The antenna surface P2 has no direct connection to the RF input/output S1, so that it represents a "parasitic element."

The antenna surface P2 also has a contact G2, which connects the antenna surface P2 to the ground for the mobile radio. When the antenna surface P2 is connected to ground, it forms a $\lambda/4$ resonator, which requires only half the surface area of a $\lambda/2$ resonator (without a ground connection).

The third frequency band can be selected by selecting the length and width of the antenna surface P2. The antenna surface P2 is excited via electromagnetic coupling between the antenna surface P1 and the antenna surface P2. An optimum reflection coefficient $S_{11}$ can be provided for a third frequency by selection of the surface area F1.

Figure 2:
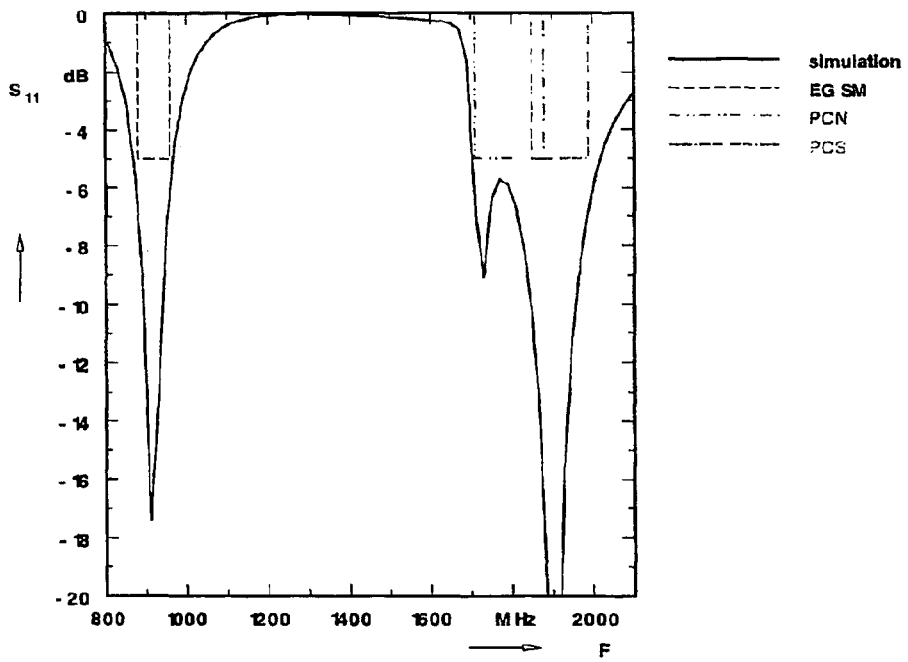
FIG. 2 shows calculated reflexion coefficients $S_{11}$ for the PIFA antenna apparatus according to the present invention.

FIG. 2 uses a solid line to show the reflection coefficients $S_{11}$ of the PIFA antenna apparatus according to the present invention, calculated in a known manner, plotted against the frequency F.

The frequency bands for GSM operation are shown as dashed lines in the range between about 880 and 960 MHz, those for PCN operation are shown in the range between about 1710 and 1880 MHz and those for PCS operation are shown in the range between about 1850 and 1990 MHz.

The simulation results plotted in FIG. 2 show that the PIFA antenna apparatus according to the present invention complies with the requirements for operation in these three frequency bands.

Overall, the present invention provides a PIFA antenna apparatus for three frequency bands, whose physical dimensions correspond to those of a dual-band PIFA antenna, and which allows installation in existing mobile radios.

It is self-evident that the features of the present invention mentioned above can be used not only in the respectively stated combination but also in other combinations or on their own, without departing from the scope of the invention. Indeed, although the present invention has been described with reference to specific embodiments, those of skill in the art will recognize that changes may be made thereto without departing from the spirit and scope of the present invention as set forth in the hereafter appended claims.

What is claimed is:

1. A PIFA antenna apparatus, comprising:

an RF input/output; and first and second antenna surfaces having respective contacts to a ground for a mobile communications terminal, wherein only the first antenna surface is connected to the RF input/output, and the second antenna surface is particularly arranged to not touch the first antenna surface such that the first and second antenna surfaces are electromagnetically coupled, with a first designated area being provided, which is substantially surrounded by the first antenna surface, within which the second antenna surface is particularly arranged, the first designated area being one of a separate surface and a cutout within the first antenna surface;

wherein the first antenna surface is designed for two independent frequencies, the second antenna surface is designed for a third independent frequency, the first antenna surface is open at one side, and a size of a free surface between the first and second antenna surfaces is selected to produce a desired input impedance for the antenna apparatus at the third frequency.

2. A PIFA antenna apparatus as claimed in claim 1, wherein the second antenna surface is designed to form a $\lambda/4$ resonator with a ground contact.

3. A PIFA antenna apparatus as claimed in claim 1, wherein a length and a width of the second antenna surface are matched to the desired third frequency.

4. A PIFA antenna apparatus as claimed in claim 1, wherein the first and second antenna surfaces have kinks and bends.

5. A PIFA antenna apparatus as claimed in claim 1, wherein the first designated area is rectangular.

6. A PIFA antenna apparatus as claimed in claim 1, wherein at least one second designated area is provided which is bounded by the first antenna surface, the second designated area being one of a separate surface and a cutout within the first antenna surface.

* * * * *